US008256246B2

(12) United States Patent
Hollenhorst et al.

(10) Patent No.: US 8,256,246 B2
(45) Date of Patent: Sep. 4, 2012

(54) AGGREGATE FOR A WASHING MACHINE WITH A PLASTIC SUDSING CONTAINER

(75) Inventors: Matthias Hollenhorst, Lippstadt (DE); Andreas Kratzsch, Bielefeld (DE); Michael Krimpmann, Rheda-Wiedenbrueck (DE); Stefano Mancini, Jesi (IT); Antje Nieder, Guetersloh (DE)

(73) Assignee: Miele & Cie. KG., Guetersloh (DE)

( * ) Notice: Subject to any disclaimer, the term of this patent is extended or adjusted under 35 U.S.C. 154(b) by 2117 days.

(21) Appl. No.: 10/978,006

(22) Filed: Oct. 29, 2004

(65) Prior Publication Data

US 2005/0092034 A1 May 5, 2005

(30) Foreign Application Priority Data

Oct. 29, 2003 (DE) ..... 103 50 793

(51) Int. Cl.
*B08B 3/06* (2006.01)
*B08B 13/00* (2006.01)

(52) U.S. Cl. ..... 68/3 R; 68/235 R

(58) Field of Classification Search ..... 68/3 R
See application file for complete search history.

(56) References Cited

U.S. PATENT DOCUMENTS

| | | | | |
|---|---|---|---|---|
| 4,423,607 | A * | 1/1984 | Munini | 68/23.2 |
| 5,115,651 | A * | 5/1992 | Nukaga et al. | 68/17 R |
| 5,433,091 | A * | 7/1995 | Durazzani et al. | 68/140 |
| 5,809,809 | A * | 9/1998 | Neumann | 68/140 |
| 5,965,236 | A * | 10/1999 | Durazzani | 428/156 |
| 6,412,312 | B1 * | 7/2002 | McClain et al. | 68/18 C |
| 6,626,014 | B2 * | 9/2003 | Heyder et al. | 68/140 |
| 7,380,423 | B1 * | 6/2008 | Musone | 68/20 |
| 2002/0069679 | A1 | 6/2002 | Skrippek et al. | |
| 2005/0138971 | A1 * | 6/2005 | Ozturk et al. | 68/3 R |

FOREIGN PATENT DOCUMENTS

| | | | |
|---|---|---|---|
| DE | 27 19 336 | | 11/1978 |
| DE | 8622028 | | 12/1986 |
| DE | 4041324 | | 6/1991 |
| DE | 4011653 | | 10/1991 |
| DE | 298 21 140 | U1 | 3/1999 |
| DE | 19911139 | | 9/2000 |
| DE | 199 60 501 | A1 | 6/2001 |
| DE | 199 40 319 | C1 | 9/2001 |
| DE | 102 16 517 | A1 | 9/2003 |
| EP | 0 043 429 | B1 | 1/1985 |
| EP | 0 374 519 | A2 | 6/1990 |
| GB | 2261881 | * | 6/1993 |
| GB | 2272913 | | 6/1994 |
| GB | 2333300 | * | 7/1999 |
| TR | 2004 02414 | T1 * | 3/2002 |

* cited by examiner

*Primary Examiner* — Michael Kornakov
*Assistant Examiner* — Natasha Campbell
(74) *Attorney, Agent, or Firm* — Leydig, Voit & Mayer, Ltd.

(57) ABSTRACT

An aggregate for a washing machine provided with a substantially hollow cylindrical suds container of fiberglass reinforced polymeric material and consisting of two end walls and a shell, a hollow cylindrical washing drum disposed in the suds container for rotation on a shaft about a non-vertical axis, and a unitary support structure embedded substantially completely in one of the end walls and with a bearing support adapted to receive the shaft and at least one arm extending radially from the bearing support.

11 Claims, 4 Drawing Sheets

Fig. I

AGGREGATE FOR A WASHING MACHINE WITH A PLASTIC SUDSING CONTAINER

BACKGROUND OF THE INVENTION

1. Field of the Invention

The invention refers to an aggregate for a washing machine with a plastic sudsing container made of a fiber glass reinforced polymeric material and consisting of a front and a rear wall held together by a shell or circularly bent wall, with a hollow cylindrical drum disposed within the sudsing container for rotation about a horizontal or inclined axis and with a bearing seat for the cantilevered bearing of the drum by receiving a shaft connected therewith. Moreover, the invention relates to a method of making an aggregate for a washing machine with a plastic sudsing container made of a fiber glass reinforced polymeric material and consisting of a front and a rear wall held together by a shell or circularly bent wall, with a hollow cylindrical drum disposed in the sudsing container for rotation about a horizontal or inclined axis and with a support structure in the area of one of the front and rear walls having in its center a bearing seat for the cantilevered bearing of the drum by receiving a shaft connected therewith.

2. The Prior Art

Washing machines with an aggregate in which the sudsing container is made of stainless steel are known, for instance, from German laid-open patent specification DE-OS 27 19 336. Stainless steel sudsing containers are also use in washing machines made and sold by the assignee of the instant invention. For their cantilevered bearing, the containers are provided with a shaft which is received by two spaced-apart bearings. The two bearings are arranged in a sleeve-like bearing seat. In the mentioned washing machines, a supporting cross made of cast iron is provided for mounting and retaining the bearing seat on the sudsing container. The support or bearing cross including the bearing seat and sudsing container are manufactured as separate components which are later assembled by screws or clamping rings.

For some time now polymeric materials, usually fiber glass reinforced, has been used for the manufacture of sudsing containers. Washing machines with polymeric sudsing drums are known, for instance, from European patent specifications 0 043 429 A1 and 0 374 519 A2 and German patent specification DE 298 21 140 A1. In the known washing machines it is customary to use a cylindrical bearing housing made of metal (usually it is a milled cast iron structure) as the bearing seat and during manufacture of the sudsing container bottom to coat it by injection of a polymeric material. From German patent specification DE 100 40 319 C1 it is also known to forego a metal bearing seat and to coat the bearings by injection of a polymer. Variants in which a support cross is separately made and mounted on the sudsing container, as is the case with stainless steel sudsing containers, are not known and are not useful since, for reasons to be explained hereinafter, the connecting points are subjected to high loads which could result in breaking of the polymer.

German laid-open patent specification DE-OS 199 60 501 A1 discloses a sudsing container of polymeric material and provided with a cylindrical bearing housing. The bearing housing is provided with an additional rotationally symmetric collar for receiving and mounting a stator of a direct drive. However, the injected polymer extends only to the outer margin or outer end of the collar. Since the bearing housing with its integrated stator support component are of small diameter, it transmits very large forces to the rear wall of the sudsing container which needs to be compensated by relatively involved structural means such as reinforcing ribs. Also, heat dissipation of the bearing is not optimal, so that large temperature peaks and differences in temperature within the rear wall of the suds container are possible.

At nowadays common spinning revolutions of up to 1,800 $min^{-1}$, friction in the area of the bearings may result in heat generation of temperatures in the range of about 100° C. In known aggregates with polymeric suds containers, such generated heat is dissipated either through the bearing housing or directly to the bottom of the suds container. This may damage the material and loosen the connection between the metal and polymeric material. At imbalances caused by a non-symmetric distribution of laundry in the drum, the high revolutions also generate high flexural forces which are diverted to the bottom of the suds container by way of the bearings. This may also damage the bottom itself or its connection with the bearing housing as well as the curved wall or shell of the suds container.

German laid-open patent specification DE-OS 102 16 517 A1 discloses a method of manufacturing a sudsing vat made of polymeric material. Mechanical components are placed into an injection mold and inserted into the suds container by injection-coating. For the precise and reliable placement of the mechanical operational components other measures are required, however.

OBJECTS OF THE INVENTION

It is, therefore, an object of the invention to provide an aggregate for a washing machine with a suds container made of a polymeric material in which forces and high temperatures are safely dissipated from the area of the bearings. Moreover, it is an object of the invention to provide a simple and economic method of manufacturing such an aggregate.

Other objects will in part be obvious and will in part appear hereinafter.

SUMMARY OF THE INVENTION

In accordance with the invention, the object is accomplished of a one-piece support structure provided with a bearing seat in its center and four radially extending arms.

Preferably, the support structure is preferably manufactured by making it unitary component made of cast iron and provided with centering lugs bearing lugs, placing the component into an injection mold and producing a front or rear wall of a suds container by injection coating the support structure with a fiberglass reinforced polymeric material such that the support structure is substantially completely embedded in the wall.

In addition to excellent force and heat diversion from the area of the bearings, the advantages resulting from the invention reside in an increased strength of the bottom of the suds container. Thus, there is a saving of material since the conventional stiffening rods in mass-produced washing machines with polymeric suds containers are no longer required. Moreover, the strengthening of the bottom of by sectors of different depths known from European patent EP 0 043 428 A1 can also be dispensed with in favor of a substantially planar and smooth interior surface of the suds container wall. This results in reducing the operational noise otherwise caused by laundry moving in the pockets formed by sectors.

Advantageously, connecting braces are provided between adjacent arms of the support structure. Preferably these braced are made of metal such as, for instance, cast iron.

This leads to an increased strength of the suds container bottom and improved heat dissipation. It also provides for an optimal mass distribution for the compensation of imbalance force. The connecting braces are preferably positioned between the ends of two opposite pairs of arms.

Further strengthening of the suds container bottom can be achieved by the ends of the arms being of a Y-shaped structure and by placing metallic or cast iron braces between these ends.

Advantageously, connecting braces are also provided at an intermediate section of the side of the arms opposite the end braces. Placement of the braces in this intermediate position makes it possible to produce a plurality of support structures in an interdigitated arrangement by a single casting operation.

Another advantage derived from the method of the invention resides in the fact the support structure and suds container bottom form are intimately connected without the use of any fasteners. While more economical, the aggregate is nevertheless of significant strength and stability.

In an efficacious embodiments of the method, the bearing seat may be milled prior to placing it into the support structure. The bottom and shell of suds container may be made as a unitary component which may subsequently be completed in a simple manner by the addition of the lacking front wall. When the front wall is made, one or more counter weights may be wholly or partially embedded by injection molding into the front wall. Alternatively, front wall and the counter weight may be separate components.

DESCRIPTION OF THE SEVERAL DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DETAILED DESCRIPTION OF THE PREFERRED EMBODIMENTS

Figure 1:
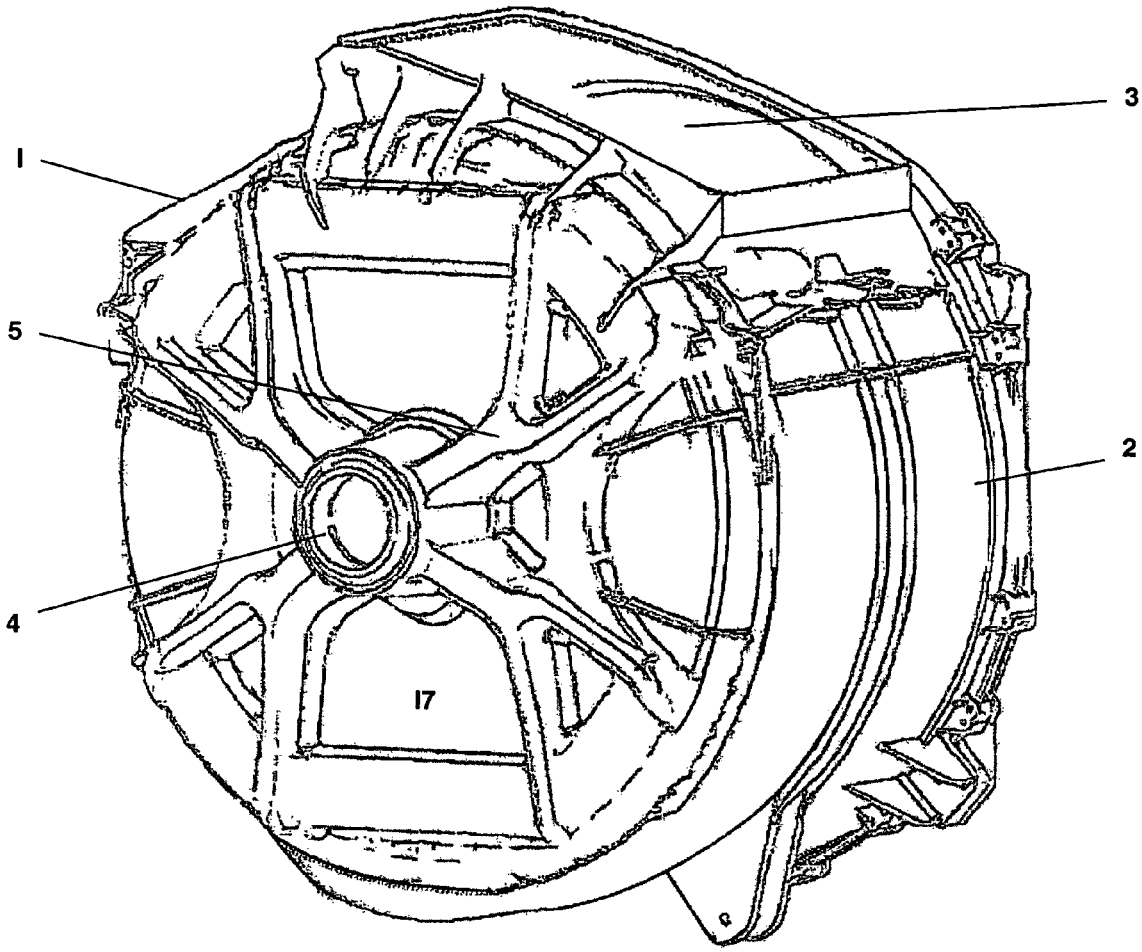
FIG. 1 is a perspective rear view of the suds container with integrated support structure.

The sudsing container 1 shown in FIG. 1 is used in connection with an aggregate of a washing machine which is loaded through a circular shell 2 of the sudsing container 1, the shell 2 being provided for this purpose with an opening 3 aligned with an opening (not shown) of a washing drum (not shown). Such washing machines are sometimes referred to as top loaders. It will be understood by those skilled in the art, that if the suds container 1 were a component of washing machine loaded from its front, the openings would be provided in the front walls of the suds container and washing drum, respectively.

Figure 2:
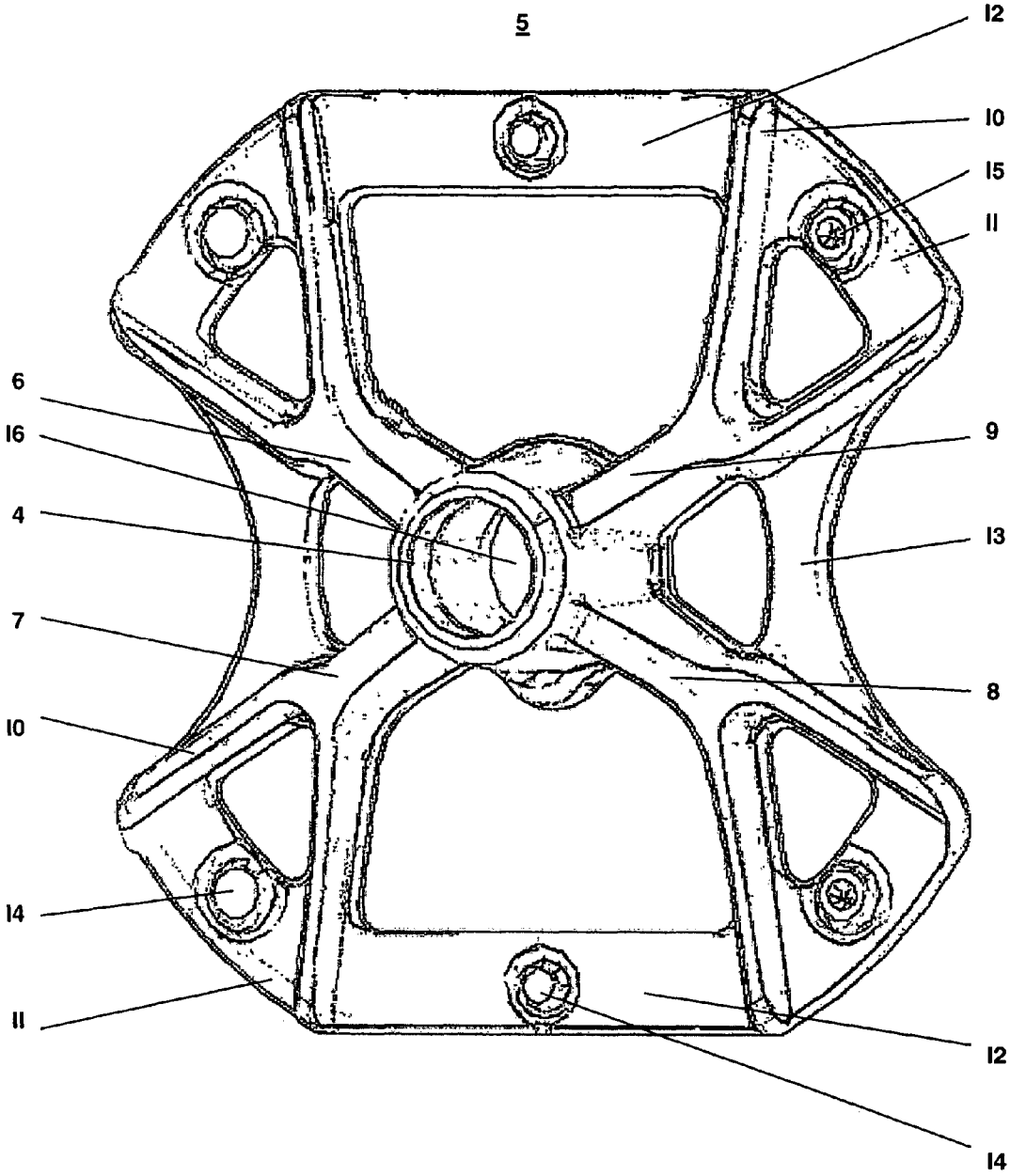
FIG. 2 is a perspective view of the support structure.

As is well known, the drum, for its cantilevered bearing support, is provided with a shaft which is received within two spaced bearings (not shown). The bearings are disposed in a tubular bearing seat 4 which is position in the center of a support structure 5 shown in detail in FIG. 2. The support structure 5 is provided with at least one, but, preferably with several radially extending arms. In a preferred embodiment, the support structure 4 is provided with four arms 6, 7, 8, 9 of which, in their installed state, two each extend radially. The terminal sections of the four arms 6, 7, 8, 9 are bifurcated (10), and the end of each of the two branches are connected by outwardly curved braces 11. Moreover, upper arms 6, 9 and lower arms 7, 8 (in FIG. 2) are connected by straight braces (12). Inwardly curved braces 13 are provided between the left arms 6, 7 and the right arms 8, 9 (in FIG. 2). The braces 11, 12, 13 thus form a substantially closed circumference of the support structure 5, intersected by two pairs of radially extending arms 6, 8 and 9, 10, respectively, and forming, in its center the bearing seat 4. The braces 11 and 12 and the two upper arms 6, 9 are provided with bearing lugs 14 or centering lugs 15 the function of which will be described hereinafter. The entire support structure 5 is manufactured as a unitary component of cast iron. In order precisely to defined the fitting of the bearings, the bore 16 forming the bearing seat 4 will be subjected to a milling operation.

Figure 3:
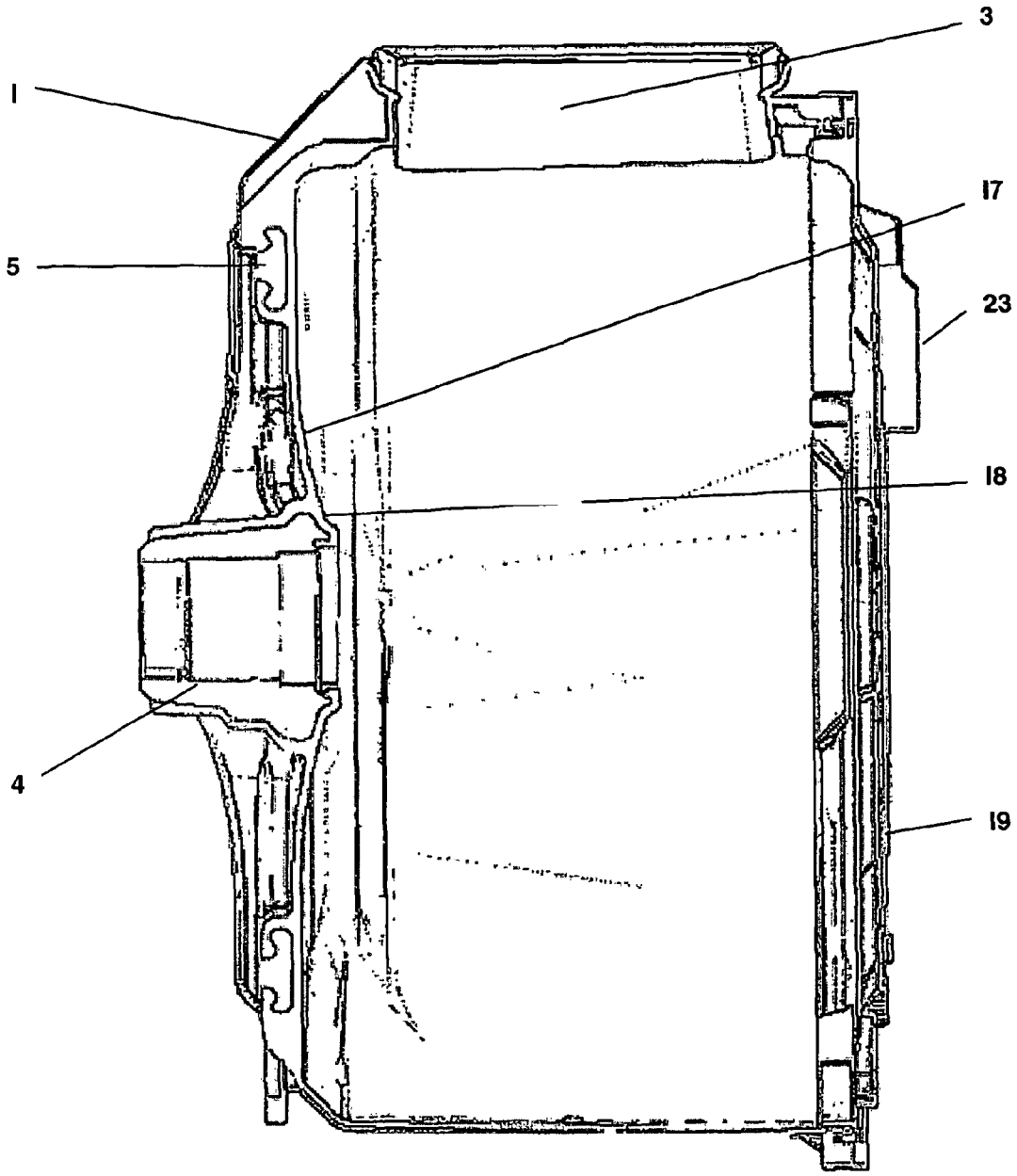
FIG. 3 is a sectional side view of the suds container.

The described support structure 5 is placed into an injection mold. For a precise alignment, the bore 16 is placed over a stud (not shown). Precise angular positioning is accomplished by the centering lugs 15, and the bearing lugs 14 prevent the structure 5 from tilting. Thereafter, the structure 5 is covered almost entirely by injection molding with a fiberglass reinforced polymeric material. Only the bearing and centering lugs 15 and the bore 16 remain uncovered. In this fashion a unitary vat is produced which forms the shell 2 and, as a first end face, the bottom 17 of the suds container 1, with the structure 5, but for the exceptions mentioned supra, being embedded completely in the bottom 17. FIG. 3 shows the embedding the structure 5 in a sectional view. It may also be seen in FIG. 3 that except for the bulging 18 in the area of the bearing seat 4 the interior surface of the bottom 17 is planar and smooth.

The vat is completed in a sudsing container 1 by a front plate 19 which forms the second end surface. Screw seats 20 are provided for joining the two components. It has been found to be advantages to provide two threads 21 22 in each screw seat 20. In this manner the vat and the end plate 19 can still be securely and sealingly connected, even if after repeated removals of the screws one of the threads has become worn or damaged.

Figure 4:
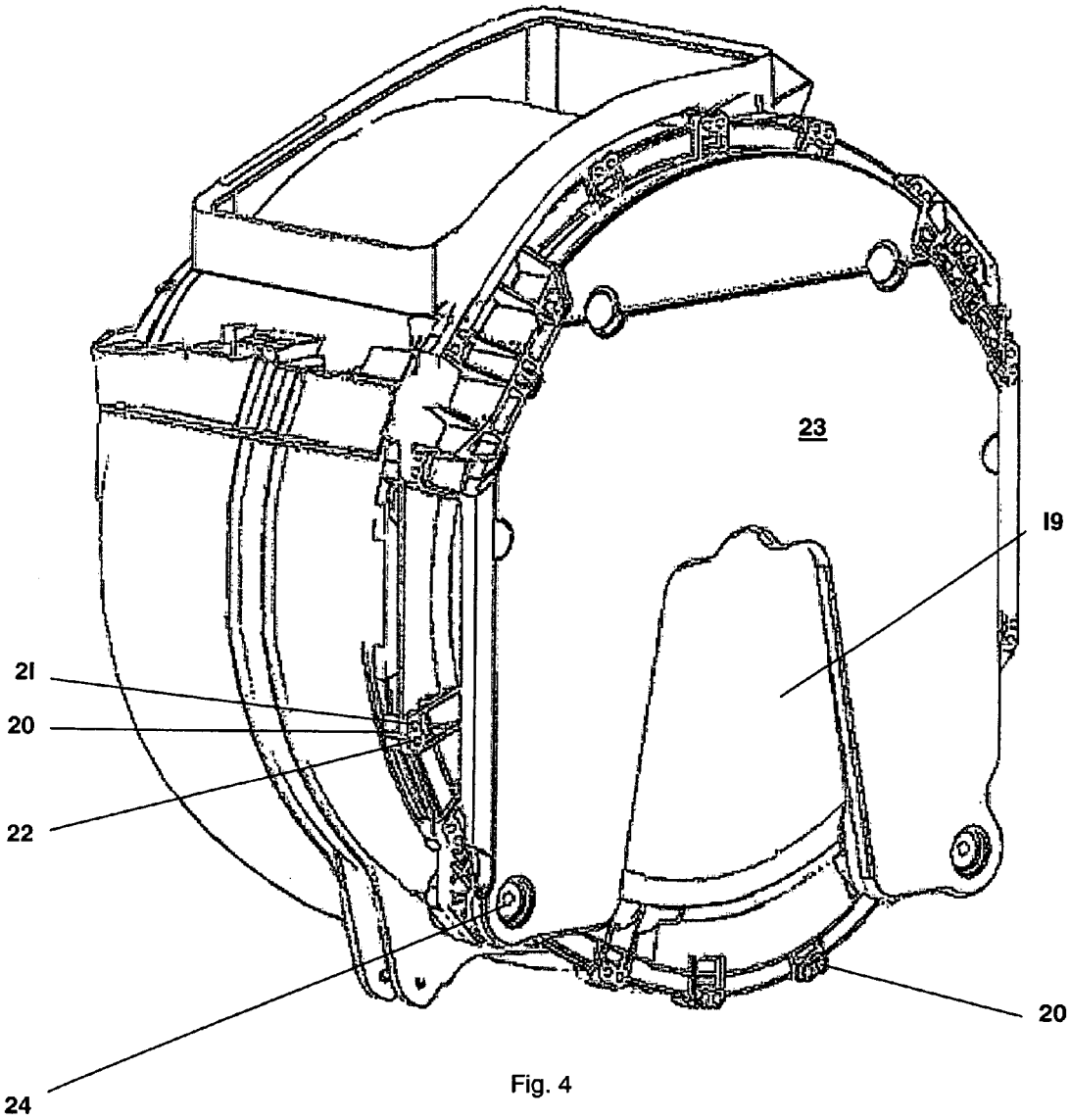
FIG. 4 is a perspective front view of the suds container.

A counter weight 23 of U-shaped configuration is shown in FIG. 4 to be mounted on the front plate 19 by further screw seats 24. Preferably, the counter weight is made of cast iron. In an alternative embodiment (not shown), instead of being a component separate from the front plate 19, may be injection molded into the front plate 19 in a manner similar to the support structure 4. This would avoid the need for a separate assembly operation.

What is claimed is:

1. An aggregate for a washing machine, comprising:

a substantially hollow cylindrical suds container of fiberglass reinforced polymeric material including two end walls and a shell;

a hollow cylindrical washing drum disposed in the suds container for rotation on a shaft about a non-vertical axis;

a unitary cast iron support structure comprising a bearing support adapted to receive the shaft and at least one arm extending radially from the bearing support, the support structure being embedded substantially completely in one of the end walls.

2. The aggregate according to claim 1, wherein the at least one arm includes four arms extending radially from the bearing support.

3. The aggregate according of claim 2, wherein free ends of the arms are bifurcated into two sections.

4. The aggregate according to claim 2, wherein the arms include a first pair interconnected by a first brace and a second pair interconnected by a second brace, the first pair being opposite the second pair.

5. The aggregate according to claim 2, wherein the arms include two opposite pairs of arms, and wherein two first opposite braces are connected to ends of the respective arms in each pair.

6. The aggregate according to claim 5, further comprising two second opposite braces, each second opposite brace connecting an intermediate section of an arm of one pair to an intermediate section of an arm of the other pair.

7. The aggregate according to claim 3, wherein the sections of each arm are connected by braces.

8. An aggregate for a washing machine, comprising:

a substantially hollow cylindrical suds container of fiberglass reinforced polymeric material including two end walls and a shell;

a hollow cylindrical washing drum disposed in the suds container for rotation on a shaft about a non-vertical axis; and a unitary metal support structure comprising a bearing support adapted to receive the shaft and at least one arm extending radially from the bearing support, the support structure being embedded substantially completely in one of the end walls.

9. The aggregate according to claim 1 wherein a free end of the at least one arm is bifurcated into two sections such that the at least one arm has a Y-shape.

10. The aggregate according to claim 8 wherein a free end of the at least one arm is bifurcated into two sections such that the at least one arm has a Y-shape.

11. The aggregate according to claim 1 wherein the at least one arm is embedded in the one of the end walls so as to be coated by the polymeric material.

* * * * *